US006348864B1

(12) United States Patent
Lin et al.

(10) Patent No.: US 6,348,864 B1
(45) **Date of Patent: *Feb. 19, 2002**

(54) ORGANIZER MANAGEMENT SYSTEM USING R.F. IDENTIFICATION

(75) Inventors: Fong-Jei Lin, Saratoga; Shengbo Zhu, San Jose, both of CA (US)

(73) Assignee: Magnex Corporation, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/565,992

(22) Filed: May 6, 2000

(51) Int. Cl.[7] ..... G08B 13/14

(52) U.S. Cl. ..... 340/570; 340/539; 340/568.1; 340/825.49; 364/479.14

(58) Field of Search ..... 340/570, 568, 340/568.1, 825.49, 539; 364/479.14, 900; 235/385

(56) References Cited

U.S. PATENT DOCUMENTS 3,648,241 A * 3/1972 Naito et al. ..... 340/147 R
4,060,795 A * 11/1977 Harumiya et al. ..... 364/900
4,267,942 A * 5/1981 Wick, Jr. et al. ..... 221/2
4,661,806 A * 4/1987 Peters et al. ..... 340/568
5,038,023 A * 8/1991 Saliga ..... 235/385
5,703,785 A * 12/1997 Bluemel et al. ..... 364/479.14
5,977,875 A * 11/1999 Lin et al. ..... 340/570
6,075,441 A * 6/2000 Maloney ..... 340/568.1

* cited by examiner

*Primary Examiner*—Daniel J. Wu
*Assistant Examiner*—Phung T Nguyen

(57) ABSTRACT

An organizer management system for facilitating the location of an item stored in one of several drawers in one or more drawer organizer cabinets. Each drawer has an LED mounted on a front panel and a circuit having a crystal with a specific resonant frequency. The resonant frequency of the crystal in a given drawer is different from all other crystals in the system. All drawer circuits are coupled in parallel to a computer-controlled r.f. signal generator. To locate a particular item, the user enters a description of the item into a system computer, which contains a list of items in the system and the corresponding frequency for each item. The computer then operates the r.f. generator to generate an r.f. signal of the correct frequency for the specified item. The LED on only the drawer containing that item is activated, so that the user can visually locate the correct drawer.

20 Claims, 7 Drawing Sheets

ORGANIZER MANAGEMENT SYSTEM USING R.F. IDENTIFICATION

BACKGROUND OF THE INVENTION

This invention relates to drawer organizer systems in general, and in particular to an improved drawer organizer management system using R.F. drawer identification.

Drawer organizer systems are known and are used generally to store small items in drawers which are slidably mounted in a cabinet designed for this purpose. The cabinet is usually fixed to a wall or a support surface, such as a work bench. Each drawer typically has a drawer pull mounted on a front panel so that a user can slide the drawer outwardly from the cabinet and gain access to the contents of the drawer. Cabinets and drawers have been fabricated from both metal and plastic, with some drawer organizers using metal for both the cabinet and the drawers, others using plastic for both the cabinet and the drawers, and others using a metal cabinet and plastic drawers. The plastic materials used in the past have been either opaque or translucent.

Many types of items can be stored in a drawer organizer. Some examples are fasteners of several kinds, such as nuts, bolts, washers, sheet metal screws, and wood screws; grommets of various sizes; O-rings; electrical connectors; and small electronic components, such as diodes, resistors, and capacitors. Drawer organizers are found in homes, work shops and manufacturing facilities and have proven to be useful in a wide variety of situations requiring the organized storage of small items for future access.

A principal difficulty encountered with the use of drawer organizers lies in the manner of retrieving desired items from the collection of items stored in the several drawers in a given cabinet. In particular, retrieving the correct item requires identifying the contents of individual drawers until the correct drawer is found. In some applications, visual inspection through a transparent front drawer panel is the technique relied upon to identify the types of articles contained in that drawer. In other applications, small labels are adhered to the front panel of the drawers, with each label containing a brief description of the articles contained in that drawer. Both techniques are less than optimal. The visual inspection technique divulges only a minimum of subjective information about the contained articles. Similarly, the label technique is limited by the amount of space available on the label to describe the contained articles. Depending on the nature of the contained articles, the label technique cannot adequately distinguish the articles in one drawer from the articles in other drawers. For example, if the contained articles are resistors of different resistance values and power ratings, it is at best difficult to adequately distinguish among the several choices. The label technique also suffers from the disadvantage that the labels must be changed whenever the kinds of articles contained in a given drawer are changed. Both techniques are relatively inefficient in enabling quick identification of the correct drawer in applications having large collections of different types of articles. In general, the larger the number of drawers, the slower the access time to the contents of the desired drawer.

SUMMARY OF THE INVENTION

The invention comprises a drawer organizer management system which is devoid of the above-noted limitations and disadvantages, which can be implemented using any articles suitable for containment in an organizer drawer, and which greatly facilitates ready access to specific items contained in organizer drawers.

In a broadest aspect the invention comprises a drawer organizer management using r.f. identification of individual drawers in a cabinet. The system includes a cabinet having a structure including a rear wall for providing a plurality of drawer locations, the cabinet having a plurality of pairs of external terminals adapted to be coupled to an r.f signal generator for receiving r.f. signals from the generator, with each of the external terminal pairs being arranged preferably on the rear wall in a position corresponding to a different one of the drawer locations.

A plurality of drawers are each slidably mounted in a different one of the drawer locations between a closed position and an opened position. Each of the plurality of file drawers has a pair of electrically conductive drawer terminals adjacent the rear thereof and are adapted to engage a corresponding pair of the external terminals, a pair of electrical r.f. signal conductors coupled to the drawer terminals, and an r.f. circuit coupled to the pair of r.f. signal conductors. Each of the r.f. circuits has a crystal resonant at a specific frequency and a visible indicator activated whenever the associated crystal detects an r.f. signal at the specific frequency of that crystal. The resonant frequency of each of the crystals is different from the remaining ones of the crystals so that an r.f. signal of a specific frequency applied to the external input terminals of the cabinet causes only one of the plurality of crystals to resonate and only the visible indicator associated to that crystal to be activated.

Each of the drawers has a front panel, and the indicators are located on the front panel so as to provide a visible indication of a resonant crystal in the drawer when the drawers are closed. Each of the visible indicators preferably comprises an LED. Each of the drawers also has a rear panel, and the pair of electrically conductive drawer terminals is preferably mounted on the rear panel. Each of the drawers is further provided with a positive detent mechanism for promoting contact between the electrically conductive drawer terminals and the external terminals. Each of the drawers is also provided with a pair of positive contact elements, such as a pair of springs, for promoting contact between the electrically conductive drawer terminals and the external terminals The system is used to locate the drawer containing a desired type of item in the following manner. A user enters the identity of a desired item in the system computer, either via a keyboard or by using a mouse to select an item from a list displayed on the computer monitor. In response, the computer performs a table-lookup from a set of frequencies which are uniquely associated to the items stored in the drawers. Once the corresponding frequency has been found, the computer instructs the r.f. signal generator to generate r.f. signals of the correct frequency. These r.f. signals are coupled to the individual cabinet drawers, and the r.f. circuit having the crystal of the correct frequency resonates, thereby illuminating the corresponding visible indicator on the drawer front panel. The user now knows which drawer contains the desired item.

The invention provides a low cost, effective and convenient technique for facilitating the location of specific items contained in a drawer organizer system. In addition, the invention eliminates, or substantially reduces the need for reliance on, the labelling practice currently followed in setting up drawer organizer systems. Moreover, the invention affords a flexibility in arranging drawer organizers hitherto unavailable. In particular, the identity of the items in any given drawer can be easily changed by modifying the description in the system computer. Also, additional drawers can be added to expand the inventory held in the system, and existing drawers can be deleted from the system by changing the information stored in the computer.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
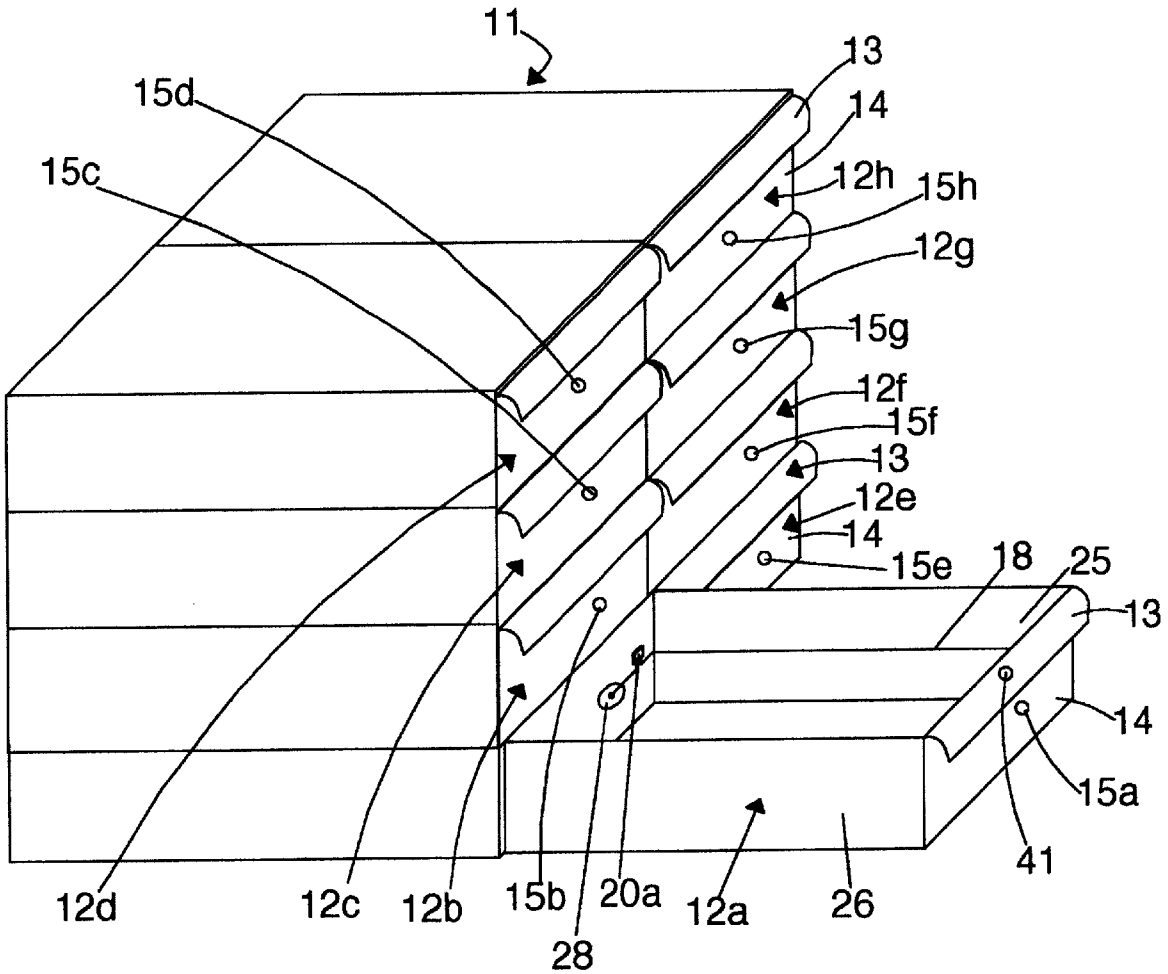
FIG. 1 is a perspective view of a drawer organizer incorporating the invention.
Figure 2:
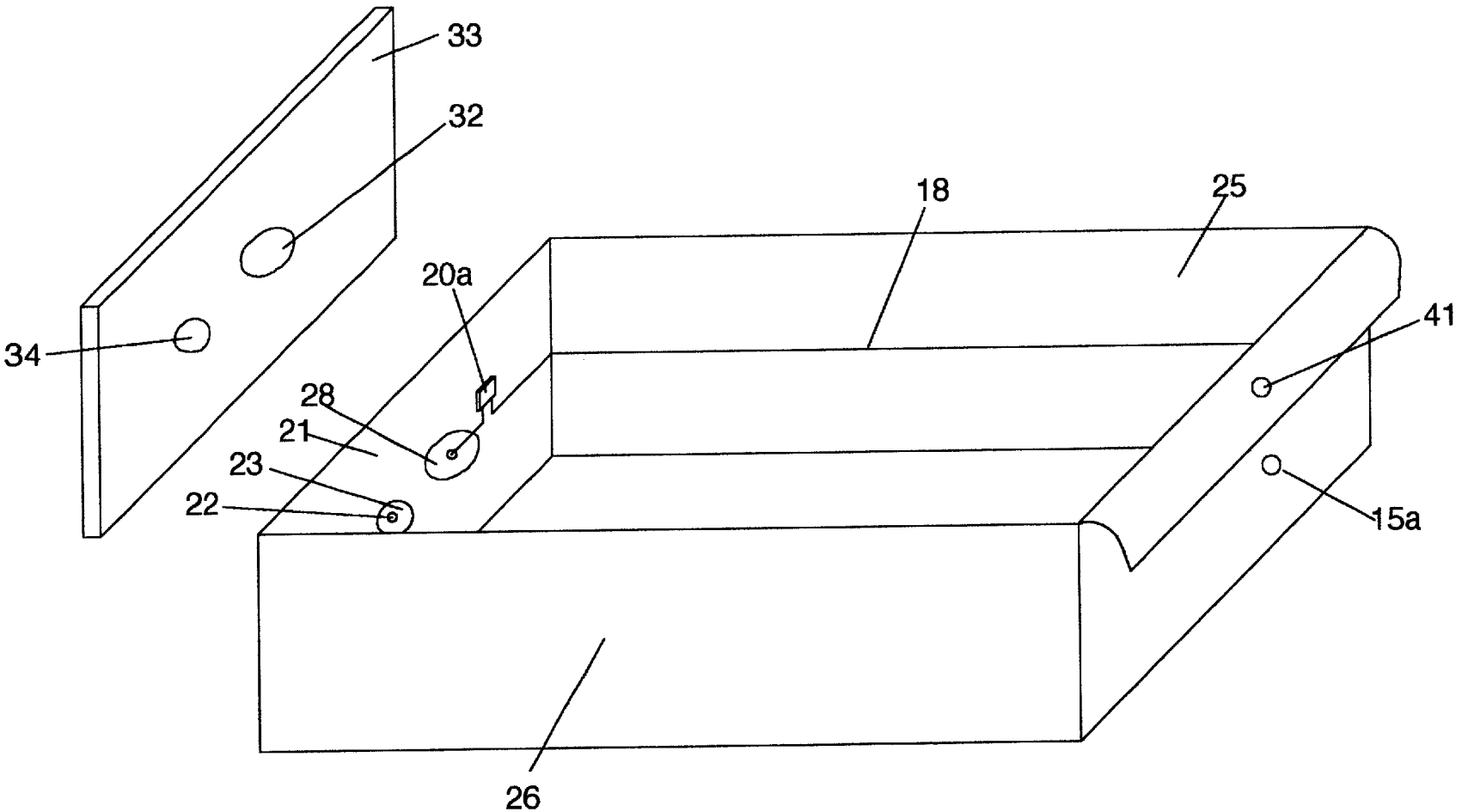
FIG. 2 is a perspective view of a single drawer and a portion of the rear cabinet wall of the embodiment of FIG. 1.
Figure 3:
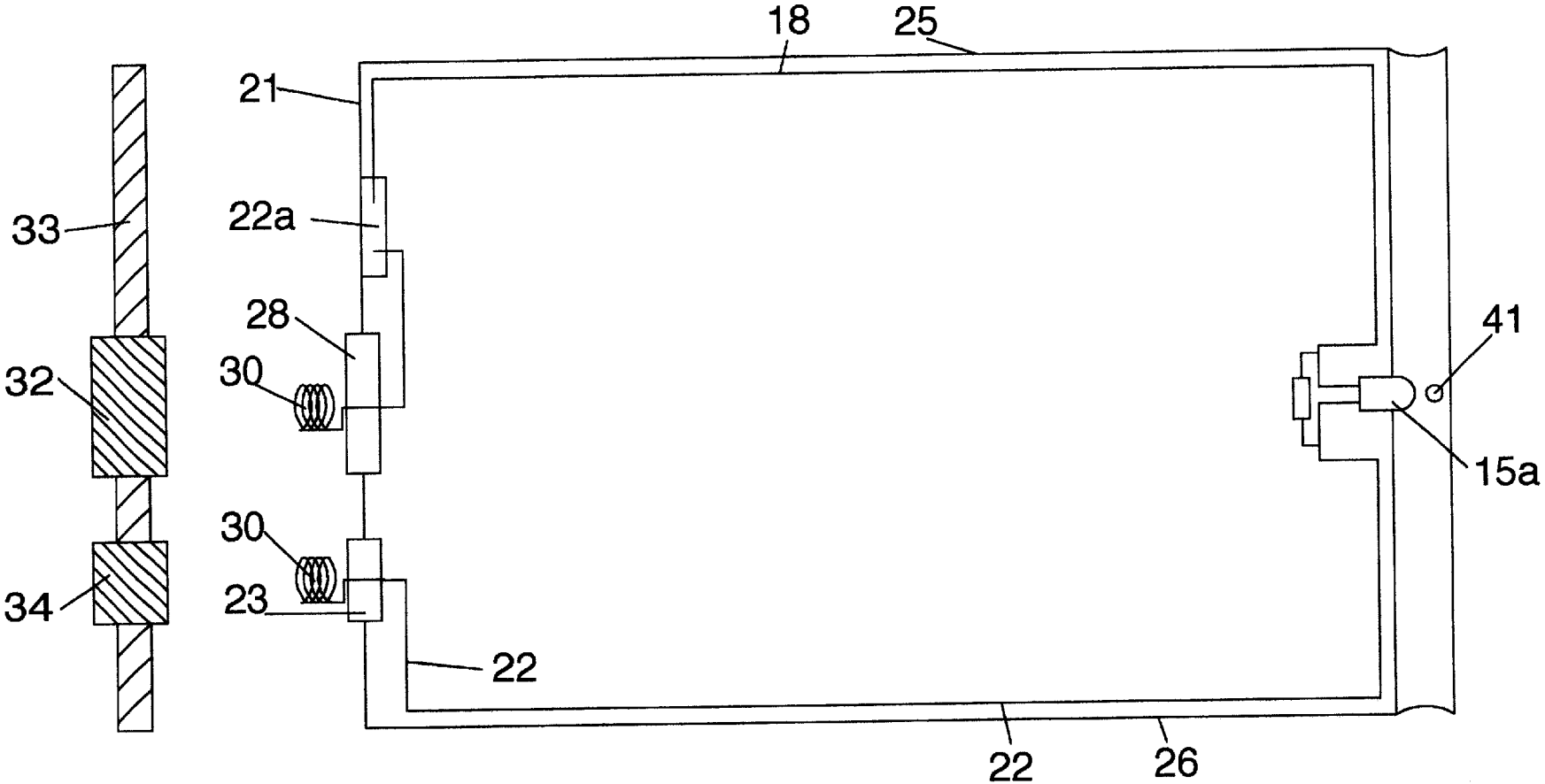
FIG. 3 is a top plan view of the drawer of FIG. 2.

Turning now to the drawings, FIG. 1 is a schematic perspective view taken from the left front of a drawer organizer incorporating the invention. As seen in this Fig., a cabinet generally designated with reference numeral 11 has a plurality of open locations for slidably housing a plurality of individual, essentially identical organizer drawers 12*a*–12*h*. Each drawer 12*a*–12*h* has substantially similar physical dimensions so that any of the drawers 12*a*–12*h* can be installed in any of the drawer locations in cabinet 11. Each drawer 12*a*–12*h* has a drawer pull 13 integrally formed with or attached to a front drawer panel 14 to facilitate opening and closing of the drawer. Each drawer 12*a*–12*h* has a visible indicator 15*a*–15*h* mounted on the front drawer panel 14. Visible indicators 15*a*–15*h* are preferably low cost light emitting diodes (LEDs), although other types of visible indicators, such as a flashing LED, incandescent lamps or liquid crystal displays (LCDs), may be used for this purpose.

With reference to FIGS. 1–4, and taking drawer 12*a* as representative, a diode 17 is electrically connected across visible indicator 15*a*. One side of diode 17 and visible indicator 15*a* are electrically connected by means of a first conductor 18 to a first terminal of a crystal 20*a* preferably mounted on a rear drawer panel 21. The other sides of diode 17 and visible indicator 15*a* are electrically connected by means of a second connector 22 to a ground return terminal 23 preferably located on rear drawer panel 21. Conductors 18 and 22 are routed along side walls 25, 26, respectively of drawer 12*a* in any suitable fashion. For example, side walls 25, 26 may be fabricated from plastic and conductors 18 and 22 may be discrete conductors with or without an encapsulating insulative covering and adhered to the surface of side walls 25, 26. Alternatively, side walls 25, 26 may be fabricated from plastic and conductors 18 and 22 may be discrete conductors embedded therein. For drawers having side walls 25, 26 fabricated from metal, conductors 18 and 22 may be discrete conductors with an encapsulating insulative covering and adhered to the surface of side walls 25, 26. Other arrangements will occur to those skilled in the art.

The other terminal of crystal 20*a* is connected via a conductor 27 to an r.f. input terminal 28 preferably mounted on rear drawer panel 21. Input terminal 28 is provided with a positive contact element, such as the spring 30 illustrated in FIG. 3, in order to establish a repeatable positive ohmic contact with an r.f. input contact terminal 32 mounted on a rear cabinet wall 33, shown in partial section in FIG. 3. A similar arrangement is made for ground return terminal 23 and a ground return terminal 34 mounted on rear wall 33 of cabinet 11. Spring 30 make take the form of a helical spring, as shown, or other forms, such as a flat leaf spring, a double folded leaf spring, or any other equivalent positive contact mechanism known to those skilled in the art. Both contacts 32 and 34 are physically located on rear cabinet wall 33 in a position which ensures positive engagement with drawer mounted terminals 23, 28 when the drawer 12*a* is closed. Each drawer 12*a*–*h* is provided with a pair of terminals 23, 28.

Figure 4:
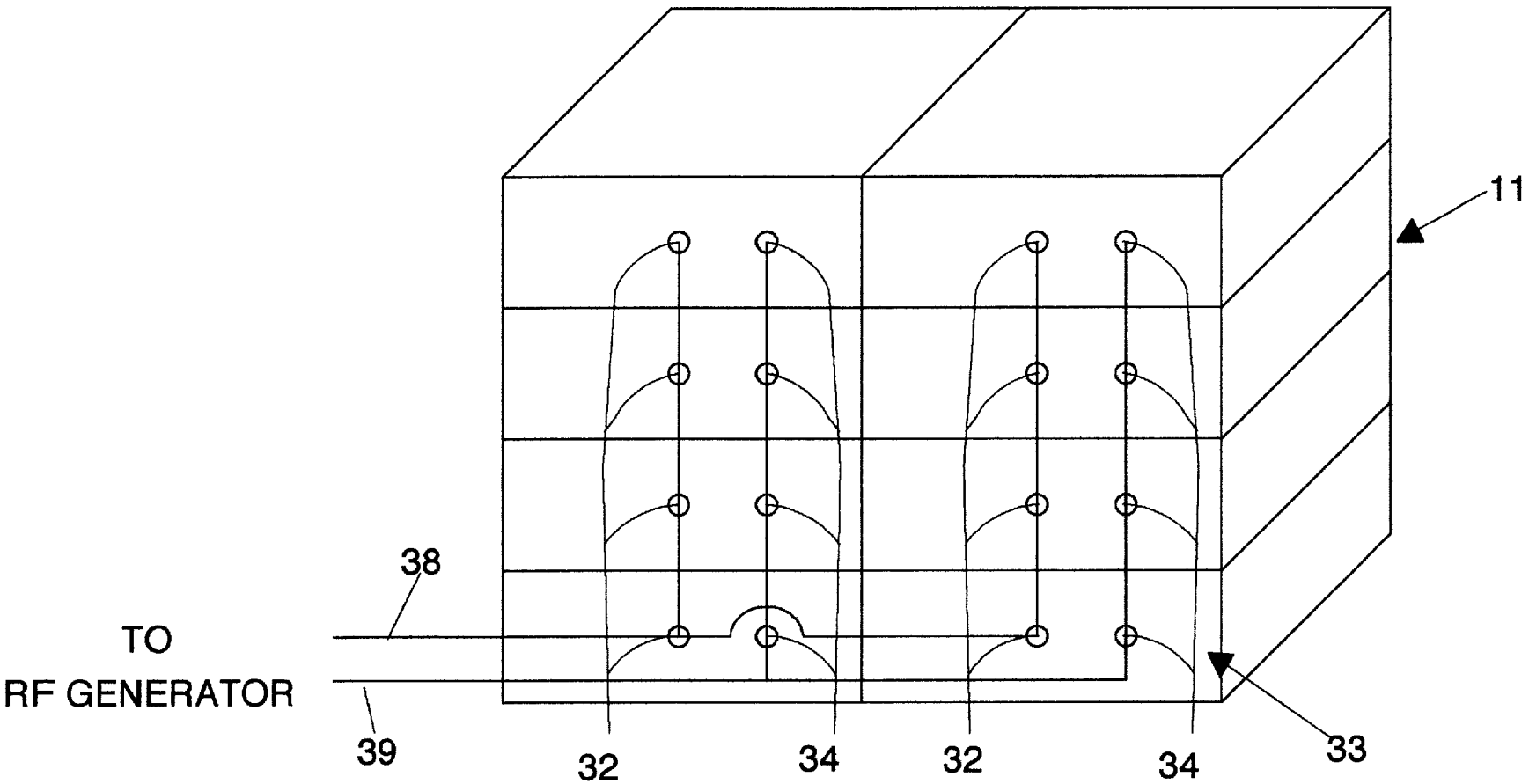
FIG. 4 is a rear perspective view of the drawer organizer of FIG. 1.

With reference to FIG. 4, rear wall 33 of cabinet 11 is provided with a plurality of pairs of contact terminals 32, 34 corresponding in number and position to the drawer terminals 23, 28. All r.f. input terminals 32 are electrically connected in common to an r.f. input conductor 38. Similarly, all ground terminals 34 are electrically connected in common to a ground return conductor 39. Conductors 38, 39 are coupled to an r.f signal generator (not illustrated) located at a convenient location relative to cabinet 11. The r.f. signal generator is preferably controlled by a computer, such as a personal computer (PC). When r.f. signals are produced by the r.f. signal generator, these signals are coupled via conductors 38, 39 to the contact terminals on rear wall 33 of cabinet 11.

Crystal 20*a* is a small, low cost crystal having a specific resonant frequency which presents a very low impedance path to r.f. signals of matching frequency when present on r.f. input terminal 28. When that specific matching frequency is present, the visible indicator 15*a* on the front drawer panel 14 of drawer 12*a* is illuminated in the manner described below. Each of the remaining organizer drawers 12*b*–*h* has a similar crystal 12*b*–*h*. The resonant frequency of each crystal 20*a*–*h* is different from all the other crystals. Consequently, only the visible indicator 15*a*–*h* on the drawer 12*a*–*h* containing the crystal 20*a*–*h* whose resonant frequency matches the frequency of any r.f. signal present on r.f. input terminal 28 will be illuminated.

Figure 5:
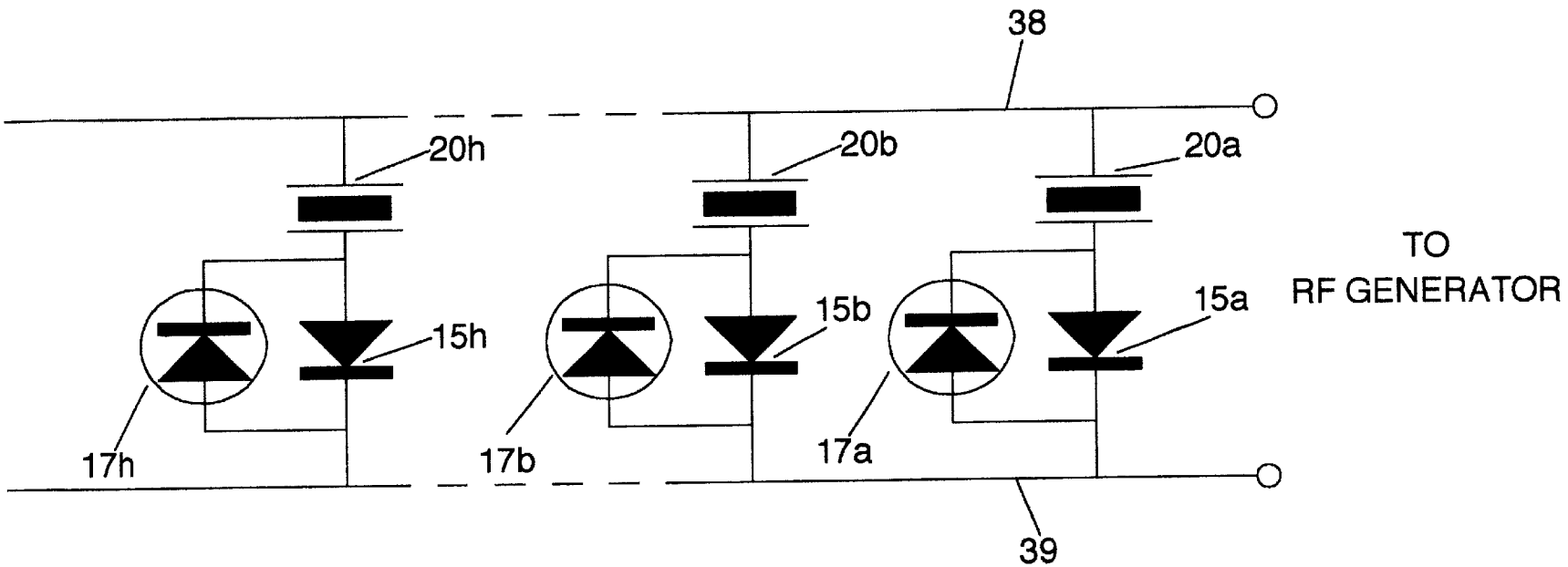
FIG. 5 is a circuit diagram showing the r.f. identification components.

FIG. 5 is a circuit diagram showing the interconnection between all drawer circuits in a single cabinet 11. As seen in this Fig., each drawer circuit includes the crystal 20, LED visible indicator 15 and diode 17, with all drawer circuits electrically coupled in parallel across conductive terminals 38, 39. As noted above, each crystal 20 in a given drawer circuit has a resonant frequency different from that of the crystals in the other drawer circuits. All resonant frequencies are preferably in the r.f. range of the spectrum, and may range in value from about 2 MHz. to about 12 MHz. The frequency separation between crystals is a matter of design choice, and good results have been obtained with crystals in the approximately 5.000 MHz range by using a minimum frequency separation of 0.001 MHz.

When a signal having an r.f. component whose frequency matches the resonant frequency of a crystal 20 of one of the drawers is present on conductor 38, that crystal will resonate and present a low resistance to the passage r.f. current through that branch of the circuit. The flow of r.f. current through that branch will cause the corresponding LED 15 to be activated.

In order to promote positive contact between the drawer contact terminals 23, 28 and the rear cabinet wall contact terminals 32, 34, a detent mechanism is preferably provided for each drawer 12 when in the closed position. The particular form of detent mechanism is not critical, and many forms are effective. For example, the detent mechanism may comprise a dimple 41 formed on the upper surface of the drawer pull 13, which will mechanically engage a confronting forward wall portion of cabinet 11 when the drawer 12 is pushed shut. If desired, a corresponding recess (not illustrated) may be formed in the confronting forward wall portion of cabinet 11 to provide a socket for dimple 41. Alternatively, a mechanical latch may be incorporated along the side walls or at the rear of drawers 12*a–h* and positioned in such a manner to mechanically engage an appropriately-configured catch in cabinet 11. Still further, a small magnet may be attached to each drawer 12*a–h*, and a magnetic member may be attached to, or formed in, cabinet 11 in a convenient location so that the drawers will be retained in the closed position in cabinet 11 by magnetic force. Other equivalent arrangements will occur to those skilled in the art.

Figure 6:
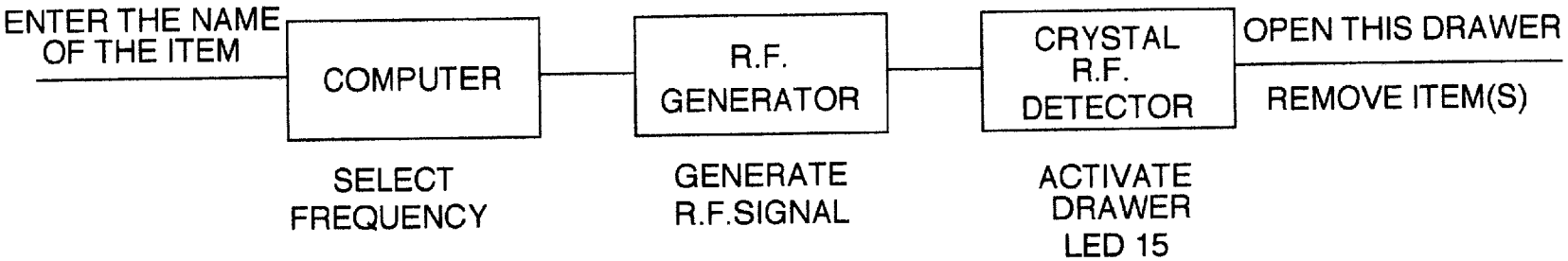
FIG. 6 is a flow chart illustrating use of the invention to locate a specific item.

FIG. 6 is a flow chart which illustrates the operation of the invention to find a single item in one of the drawers 12*a–h*. As seen in this Fig., the user enters the name of the desired item into the computer, typically using a keyboard, or selects a desired item from a list displayed on the computer monitor by using a mouse. The computer performs a table look-up of the resonant frequency for that particular item, turns on the R.F. signal generator, and causes an r.f signal of the correct frequency to be generated and transmitted via conductors 38, 39 and contact terminals 32, 34, 28 and 23 in parallel to all drawers 12*a–h*. The drawer circuit having the crystal of that frequency (if present in any of the drawers) will respond to the r.f. signal by illuminating the LED indicator 15 for that circuit. All other drawer circuits will not respond to the particular frequency, so that the LED indicator 15 of the correct drawer will be the only one illuminated.

The r.f. signal generator in the associated computer may comprise a sweep frequency generator capable of generating r.f. signals in a swept mode, beginning with the lowest crystal resonant frequency in the organizer management system, and ending with the highest crystal resonant frequency in the system. With such a signal generator, the integrity of the entire collection of drawers can be quickly checked by instructing the computer to activate the r.f. signal generator in the sweep mode. As the signal frequency is swept over the entire range, all drawer circuits which are present in the cabinet will resonate at their respective frequency and this can be detected at the computer using a conventional r.f. detector circuit. Any missing drawer will not respond, and this also can be detected at the computer using the same circuit. Any drawers detected as missing can be correlated to the drawer identification in the computer by noting the frequency of the non-responsive drawer circuits.

The system may be initially configured in several different ways. The most fundamental way is to place a single drawer 12 into a cabinet cause the r.f. signal generator to sweep the range of frequencies, note the frequency at which the crystal in that drawer resonates, enter that frequency number into a list, remove the drawer, insert another drawer, and repeat this process on a serial basis for all drawers required to fill the cabinet. This method works well for a new system with no existing drawers. A more useful technique is to insert a first drawer into a cabinet, sweep the r.f. frequency, note the resonant frequency, enter that number into a new list; insert a second into the cabinet without removing the first, sweep the frequency, add the resonant frequency of the new drawer to the list; insert a third drawer into the cabinet, sweep the frequency, add the resonant frequency of the third drawer to the list; etc. As each new drawer is inserted into the cabinet, the computer has a running list of frequencies already identified and, since each crystal frequency is unique, there can be no duplications. An even more sophisticated technique for initializing an organizer system, and one which is most useful for existing organizer systems having a large number of drawers already in use, proceeds as follows. With all drawers in place and closed, the r.f. generator is activated in the sweep mode, and each resonant frequency is detected and entered into a list by the computer. After all frequencies have been detected and entered, the computer initializes the R.F. generator and causes it to sweep all entered frequencies. As a given frequency is reached, the generator is locked to that frequency, the drawer LED 15 activated, and a human operator manually enters a description of the items already located in, or to be placed in, the drawer with the activated LED 15. Once the descriptive information is entered for a given frequency and drawer, the generator is activated to sweep to the next frequency in the list, and the generator is locked at that frequency until the item information for that drawer is entered into the computer. This process continues until all frequencies have been accounted for.

Figure 7:
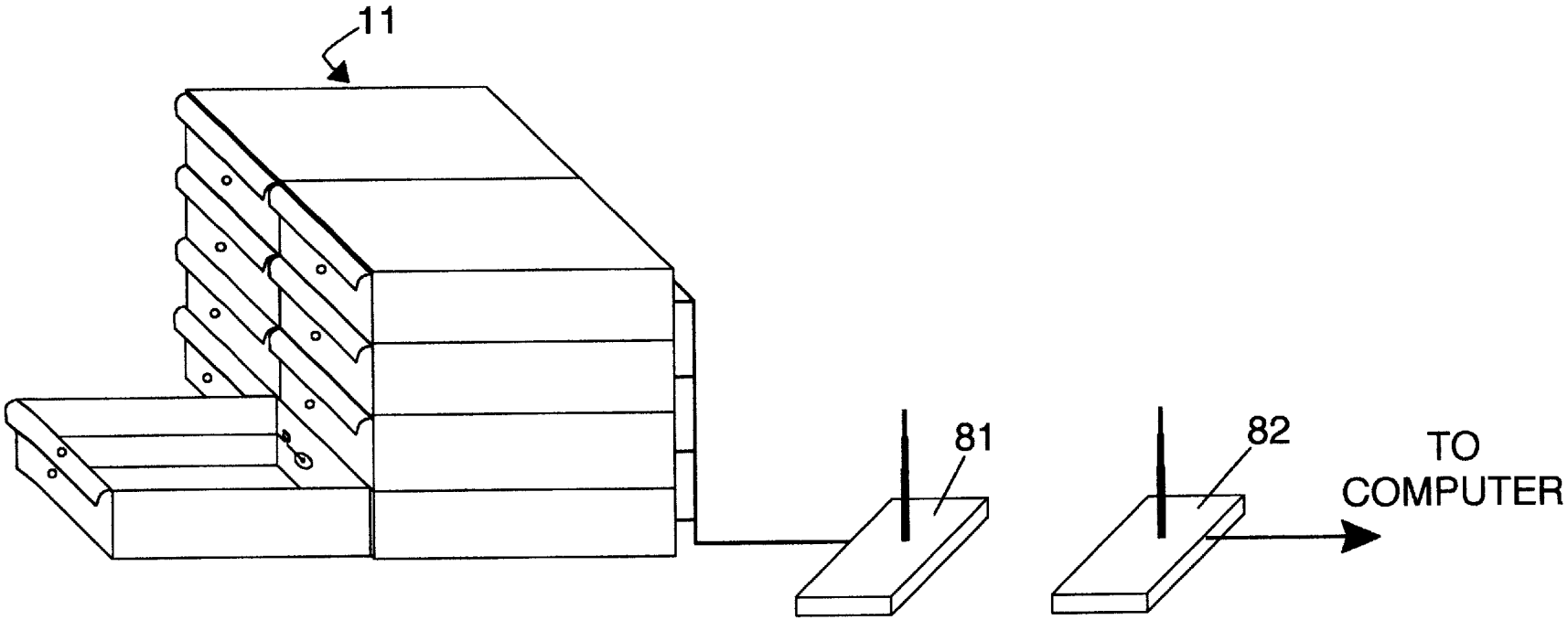
FIG. 7 is a schematic diagram of a wireless embodiment of the invention.

FIG. 7 illustrates an alternate embodiment of the organizer management system implementation of the invention using wireless communication between individual cabinets and the associated computer. As seen in this Fig., cabinet 11 is provided with a transceiver 81 for communication with the associated computer. The associated computer is provided with a matching transceiver 82. Operation of the FIG. 7 system is essentially identical to that of the FIG. 1 system, with the exception that the r.f. signals are transmitted to file cabinet 11 using transceivers 81, 82, rather that the hard wired connections of the FIG. 1 embodiment. In addition, there may be additional security considerations to the wireless embodiment of FIG. 7 to prevent unauthorized transmission and reception of the r.f. signals.

As will now be apparent, drawer organizer management systems incorporating the invention provide a number of significant advantages absent from the prior art. Firstly, since the invention provides an automatic visible indication of the drawer containing the desired items, the time to find and retrieve an item is significantly reduced. In addition, the integrity of the entire organizer system can be easily checked on a periodic or ad hoc basis in a relatively short period of time, and a list of missing drawers can be automatically compiled by the computer. Moreover, the use of visible indicators to signal the location of a specific drawer containing the item sought eliminates the need to separately identify each item by using specific descriptors attached to each drawer front panel. Consequently, any unauthorized individual wishing to find a particular drawer containing items of a specific type would be forced to inspect the contents of each individual drawer or read and interpret the drawer label found on prior art organizer drawers, which adds a significant barrier to unauthorized removal of drawer items. Still further, since the contents of a given drawer are independent of the drawer identification, the type of item associated to any drawer can be reassigned or renamed by using the computer to effect the changes. Stated differently, a drawer front panel label containing an item designation is not necessary. Thus, once a complete set of drawers is in place, there is no need to add new labels when changing the drawer contents from one item to another.

Organizer management systems incorporating the invention may also be modified using the computer to add new drawers, new cabinets with additional drawers, delete old drawers no longer considered necessary, and to rearrange the grouping of drawers.

Although the above provides a full and complete disclosure of the preferred embodiments of the invention, various modifications, alternate constructions and equivalents will occur to those skilled in the art. For example, while the invention has been described with reference to specific r.f. frequencies, other frequencies may be employed, depending on the preferences of the system designer. Moreover, while the indicators 15 have been described as visible indicators, other types of indicators, such as audible indicators, may be used, if desired. In addition, while the invention has been described with reference to a single organizer cabinet, it is understood that the invention may be implemented using multiple organizer cabinets positioned at the same or different locations in a home, workshop or manufacturing facility. Further, the invention may be used to manage an organizer system of many cabinets positioned at different physical locations using an internal or an external computer network, if desired. Therefore, the above should not be construed as limiting the invention, which is defined by the appended claims.

What is claimed is:

1. A drawer organizer management system comprising:

a cabinet having a structure including a rear wall for providing a plurality of drawer locations, said cabinet having a plurality of pairs of external terminals each arranged in a position corresponding to a different one of said drawer locations for receiving r.f. signals from a source;

a plurality of drawers each slidably mounted in a different one of said drawer locations between a closed position and an opened position, each of said plurality of drawers having a pair of electrically conductive drawer terminals adjacent the rear thereof and adapted to engage a corresponding pair of said external terminals, a pair of electrical r.f. signal conductors coupled to said drawer terminals, and an r.f. circuit coupled to said pair of r.f. signal conductors and having a crystal resonant at a specific frequency and a visible indicator activated whenever the associated crystal detects an r.f. signal at the specific frequency of that crystal, the resonant frequency of each of said crystals being different from the remaining ones of said crystals so that an r.f. signal of a specific frequency applied to said external input terminals causes only one of said plurality of crystals to resonate and only the visible indicator associated to said only one of said plurality of crystals to be activated.

2. The system of claim 1 wherein each of said drawers has a front panel; and wherein said indicators are located on said front panel so as to provide a visible indication of a resonant crystal in the drawer when the drawers are closed.

3. The system of claim 1 wherein each of said visible indicators comprises an LED.

4. The system of claim 1 wherein each of said drawers has a rear panel; and wherein said pair of electrically conductive drawer terminals is mounted on said rear panel.

5. The system of claim 1 wherein each of said drawers is provided with a positive detent mechanism for promoting contact between said electrically conductive drawer terminals and said external terminals.

6. The system of claim 1 wherein each of said drawers is provided with a pair of positive contact elements for promoting contact between said electrically conductive drawer terminals and said external terminals.

7. The system of claim 6 wherein said pair of positive contact elements each comprises a spring.

8. The system of claim 1 wherein each of said drawers is provided with a positive detent mechanism and a pair of positive contact elements for promoting contact between said electrically conductive drawer terminals and said external terminals.

9. The system of claim 8 wherein said pair of positive contact elements each comprises a spring.

10. The system of claim 1 wherein said a plurality of pairs of external terminals are mounted on said rear wall of said cabinet.

11. A drawer organizer management using r.f. identification of individual drawers in a cabinet, said system comprising:

a computer;

an r.f. signal generator coupled to said computer for generating r.f. signals of different frequencies;

a cabinet having a structure including a rear wall for providing a plurality of drawer locations, said cabinet having a plurality of pairs of external terminals coupled to said r.f. signal generator for receiving r.f. signals from said generator, each of said external terminals being arranged in a position corresponding to a different one of said drawer locations; and a plurality of drawers each slidably mounted in a different one of said drawer locations between a closed position and an opened position, each of said plurality of drawers having a pair of electrically conductive drawer terminals adjacent the rear thereof and adapted to engage a corresponding pair of said external terminals, a pair of electrical r.f. signal conductors coupled to said drawer terminals, and an r.f. circuit coupled to said pair of r.f. signal conductors and having a crystal resonant at a specific frequency and a visible indicator activated whenever the associated crystal detects an r.f. signal at the specific frequency of that crystal, the resonant frequency of each of said crystals being different from the remaining ones of said crystals so that an r.f. signal of a specific frequency applied to said external input terminals causes only one of said plurality of crystals to resonate and only the visible indicator associated to said only one of said plurality of crystals to be activated.

12. The system of claim 11 wherein each of said drawers has a front panel; and wherein said indicators are located on said front panel so as to provide a visible indication of a resonant crystal in the drawer when the drawers are closed.

13. The system of claim 11 wherein each of said visible indicators comprises an LED.

14. The system of claim 11 wherein each of said drawers has a rear panel; and wherein said pair of electrically conductive drawer terminals is mounted on said rear panel.

15. The system of claim 11 wherein each of said drawers is provided with a positive detent mechanism for promoting contact between said electrically conductive drawer terminals and said external terminals.

16. The system of claim 11 wherein each of said drawers is provided with a pair of positive contact elements for promoting contact between said electrically conductive drawer terminals and said external terminals.

17. The system of claim 16 wherein said pair of positive contact elements each comprises a spring.

18. The system of claim 11 wherein each of said drawers is provided with a positive detent mechanism and a pair of positive contact elements for promoting contact between said electrically conductive drawer terminals and said external terminals.

19. The system of claim 18 wherein said pair of positive contact elements each comprises a spring.

20. The system of claim 11 wherein said a plurality of pairs of external terminals are mounted on said rear wall of said cabinet.

* * * * *